US008065861B2

(12) United States Patent
Caputo

(10) Patent No.: US 8,065,861 B2
(45) Date of Patent: Nov. 29, 2011

(54) BLIND PACKAGING

(75) Inventor: Thomas Caputo, Greensboro, NC (US)

(73) Assignee: Newell Window Furnishings, Inc., High Point, NC (US)

( * ) Notice: Subject to any disclaimer, the term of this patent is extended or adjusted under 35 U.S.C. 154(b) by 164 days.

(21) Appl. No.: 12/349,771

(22) Filed: Jan. 7, 2009

(65) Prior Publication Data

US 2009/0301039 A1 Dec. 10, 2009

Related U.S. Application Data

(60) Provisional application No. 61/019,463, filed on Jan. 7, 2008.

(51) Int. Cl.
*B65B 35/30* (2006.01)
*B65D 85/00* (2006.01)

(52) U.S. Cl. ..... 53/445; 53/467; 53/473; 206/326; 160/166.1; 160/167 V; 160/168.1 R; 160/168.1 V

(58) Field of Classification Search ..... 53/445, 53/467, 473, 474; 206/326; 160/166.1, 167 V, 160/166.1 R, 168.1 R, 168.1 V, 173 R, 178.1 R, 160/178.2 R
See application file for complete search history.

(56) References Cited

U.S. PATENT DOCUMENTS 2,423,978 A * 7/1947 Hunter ..... 160/178.1 R
4,411,401 A * 10/1983 Anderson ..... 248/262
4,589,312 A 5/1986 Meyers et al.
4,639,987 A 2/1987 Georgopoulos
4,730,372 A 3/1988 Tsuchida
4,776,096 A 10/1988 Chang
4,790,226 A 12/1988 Tsuchida
4,807,363 A 2/1989 Clifton, Jr.
4,819,530 A 4/1989 Huang
4,876,795 A 10/1989 Chun-cheng
4,907,325 A 3/1990 Hsu
4,993,131 A 2/1991 Graves et al.
5,056,388 A 10/1991 Dekker et al.
5,103,702 A 4/1992 Yannazzone
5,339,716 A 8/1994 Sands et al.
5,349,730 A 9/1994 Anderson et al.
5,456,149 A 10/1995 Elsenheimer et al.
5,799,557 A 9/1998 Wang
5,806,394 A 9/1998 Marocco
5,816,126 A 10/1998 Pluber
5,826,317 A 10/1998 van Oostrom et al.
6,003,217 A 12/1999 Graves et al.
6,079,306 A 6/2000 Liu (Continued)

OTHER PUBLICATIONS

U.S. Appl. No. 10/908,728, filed May 24, 2005.
U.S. Appl. No. 12/839,083, filed Jul. 19, 2010.
United States Patent and Trademark Office, U.S. Appl. No. 12/579,901, Restriction Requirement, Oct. 29, 2010.

(Continued)

*Primary Examiner* — Hemant M Desai
(74) *Attorney, Agent, or Firm* — Dennis J. Williamson; Moore & Van Allen, PLLC

(57) ABSTRACT

The hardware for mounting the blinds is located in the head rail such that it does not interfere with the cutting operation but remains with the blind after the blind is cut-to-size. The hardware overlaps with a blind component and the hardware may include a mounting bracket that includes a notch for receiving the blind component. The ends of the blinds are aligned in a package by the manufacturer during the packaging process. The blinds are secured in the package such that the blind elements are properly aligned. The aligned blinds and the package are inserted into a cutting machine as a unit and the cutting machine cuts the blinds and the package simultaneously.

12 Claims, 4 Drawing Sheets

U.S. PATENT DOCUMENTS 6,089,134 A 7/2000 Marocco
6,098,694 A 8/2000 Ohanesian
6,142,196 A 11/2000 Schumann et al.
6,167,789 B1 1/2001 Daniels et al.
6,178,857 B1 1/2001 Marocco
6,196,099 B1 3/2001 Marocco
6,240,824 B1 6/2001 Hsu
6,263,945 B1 7/2001 Nien
6,314,851 B1 11/2001 Graves et al.
6,334,379 B1 1/2002 Sudano
6,336,388 B1 1/2002 Marocco
6,412,381 B1 7/2002 Wang et al.
6,427,571 B1 8/2002 Hsu
6,435,066 B1 8/2002 Kutchmarek et al.
6,560,849 B1 5/2003 Modra
6,615,698 B2 9/2003 Chuang et al.
6,644,160 B1 11/2003 Boselli
6,688,204 B2 2/2004 Huang
6,758,120 B2 7/2004 Marocco
6,758,257 B2 7/2004 Lee
6,761,099 B2 7/2004 Lin et al.
6,793,073 B2 9/2004 Tu
6,865,817 B2 3/2005 Militello et al.
6,877,409 B2 4/2005 Huang et al.
6,912,940 B1 7/2005 Atwood
6,945,152 B2 9/2005 Jabbari et al.
6,971,296 B2 12/2005 Lin et al.
6,973,364 B2 12/2005 Schwartz et al.
7,000,516 B2 2/2006 Lin et al.
7,000,521 B1 2/2006 Cheng et al.
7,007,576 B2 3/2006 Roberts et al.
7,017,459 B2 3/2006 Marocco
7,024,977 B2 4/2006 Nien
7,036,412 B2 5/2006 Abdollahzadeh
7,040,205 B2 5/2006 Roberts et al.
7,044,043 B2 5/2006 Cheng
7,059,230 B2 6/2006 Caputo et al.
7,069,832 B2 7/2006 Roberts et al.
7,069,833 B2 7/2006 Roberts et al.
7,100,485 B2 9/2006 Roberts et al.
7,104,175 B2 9/2006 Roberts et al.
7,107,889 B2 9/2006 Marocco
7,114,421 B2 10/2006 Marocco
7,118,028 B2 10/2006 Liu et al.
7,178,439 B2 2/2007 Gilboy et al.
7,194,811 B2 3/2007 Militello et al.
2003/0033919 A1 2/2003 Lin et al.
2003/0066403 A1 4/2003 Lin et al.
2003/0140756 A1 7/2003 Lin et al.
2004/0103767 A1 6/2004 Lin et al.
2005/0188515 A1 9/2005 Reimer et al.
2006/0108078 A1 5/2006 Kollman et al.
2006/0207399 A1 9/2006 Birch et al.
2007/0175782 A1* 8/2007 Nien ..... 206/320
2007/0175783 A1* 8/2007 Nien ..... 206/320
2007/0239551 A1 10/2007 Zeller
2008/0066283 A1 3/2008 Birch et al.

OTHER PUBLICATIONS

United States Patent and Trademark Office, U.S. Appl. No. 12/579,901, Non-Final Rejection, Jan. 5, 2011.
United States Patent and Trademark Office, U.S. Appl. No. 12/579,892, Restriction Requirement, Aug. 12, 2010.
United States Patent and Trademark Office, U.S. Appl. No. 12/579,892, Non-Final Rejection, Oct. 7, 2010.
United States Patent and Trademark Office, U.S. Appl. No. 12/579,892, Final Rejection, Feb. 3, 2011.
United States Patent and Trademark Office, U.S. Appl. No. 12/908,728, Restriction Requirement, Jul. 9, 2007.
United States Patent and Trademark Office, U.S. Appl. No. 12/908,728, Non-Final Rejection, Oct. 4, 2007.
United States Patent and Trademark Office, U.S. Appl. No. 12/908,728, Final Rejection, Apr. 30, 2008.
United States Patent and Trademark Office, U.S. Appl. No. 12/908,728, Non-Final Rejection, Oct. 8, 2008.
United States Patent and Trademark Office, U.S. Appl. No. 12/908,728, Final Rejection, Apr. 23, 2009.
United States Patent and Trademark Office, U.S. Appl. No. 12/908,728, Non-Final Rejection, Mar. 2, 2011.
United States Patent and Trademark Office, U.S. Appl. No. 12/685,843, Restriction Requirement, Jun. 28, 2010.
United States Patent and Trademark Office, U.S. Appl. No. 12/685,843, Non-Final Rejection, Aug. 19, 2010.
United States Patent and Trademark Office, U.S. Appl. No. 12/685,843, Final Rejection, Jan. 20, 2011.

* cited by examiner

BLIND PACKAGING

This application claims benefit of priority under 35 U.S.C. §119(e) to the filing date of to U.S. Provisional Application No. 61/019,463, as filed on Jan. 7, 2008, which is incorporated herein by reference in its entirety.

The invention relates generally to window blinds that can be cut-to-size at the point of sale and more particularly to packaging that facilitates accurate cutting of the blinds and a method of cutting blinds using the package.

BACKGROUND

It will be appreciated that window blinds come in a variety of materials including wood, plastic, fabric, vinyl and aluminum and a variety of styles including horizontal, woven, pleated, Roman and cellular. Cut-to-size blinds are sold in a limited number of sizes. The end user purchases the blind at a retail outlet in the size that most closely matches, but is larger than, the window or other architectural feature on which the blind is to be used. A cutting machine is operated to cut the blinds to the desired size.

Thus, an improved method and apparatus for accurately cutting cut-to-size blinds is desired.

SUMMARY

The invention consists of packaging the blinds in such a manner that existing cutting machines can accurately cut the blinds. The hardware for mounting the blinds is located in the head rail such that it does not interfere with the cutting operation but remains with the blind after the blind is cut-to-size. The hardware overlaps with a blind component and the hardware may include a mounting bracket that includes a notch for receiving the blind component. The ends of the blinds are aligned in a package by the manufacturer during the packaging process. The blinds are secured in the package such that the blind elements are properly aligned. The aligned blinds and the package are inserted into the cutting machine as a unit and the cutting machine cuts the blinds and the package simultaneously.

DETAILED DESCRIPTION OF THE EMBODIMENTS OF THE INVENTION

In this application the terms "size-in-store" and "cut-to-size" refer to blinds that are manufactured in a predetermined width that is not necessarily intended to fit a particular size window or other architectural feature. The blind is intentionally manufactured in a size that is wider than the window for which the blind is intended to be used. It will be appreciated that cut-to-size blinds may come in a limited number of different widths where each width is intended to be used with a range of window widths. This is done, in part, to minimize the waste that would result if only a single large width blind was used that had to be cut down to fit even the smallest window. Whether a single size blind is provided or several blind sizes are provided, the significant feature of these blinds is that they are cut to the desired size at the retail level and are not sized for use in a particular size window during the manufacturing process. The blinds are typically cut to the specific width desired by the end user or retail outlet personnel at the point of sale using cutting machines provided by the blind manufacturer. Cutting machines are also used by mail order suppliers to provide semi-custom blinds and the invention is intended to cover any application where blinds are manufactured that are intended to be cut to a desired size after manufacture. A wide variety of different types of blinds in a variety of materials may be used with the invention including, but not limited to, slatted blinds, woven blinds, cellular blinds and the like.

Figure 1:
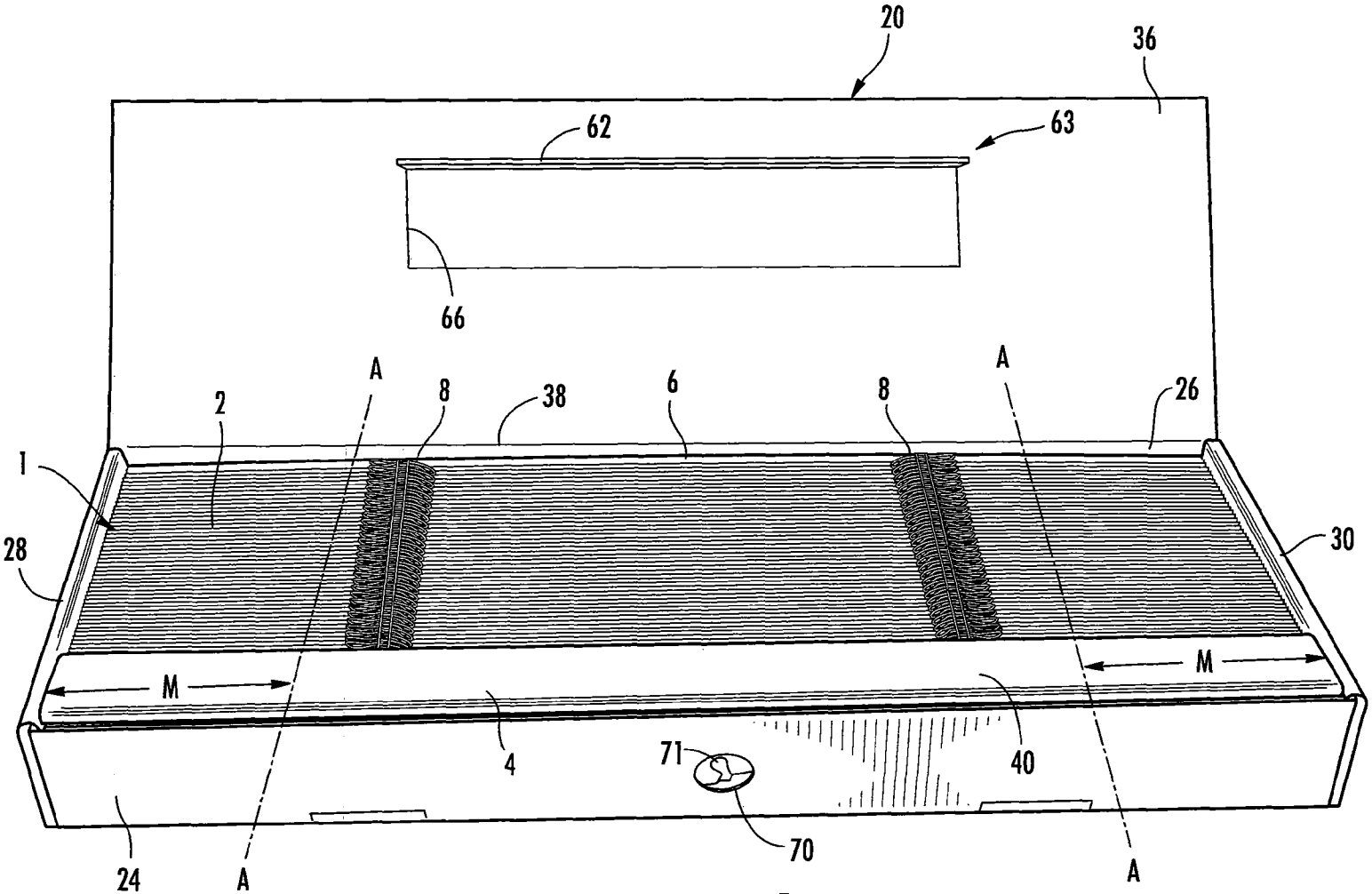
FIG. 1 is a perspective view showing a blind located in a package.
Figure 2:
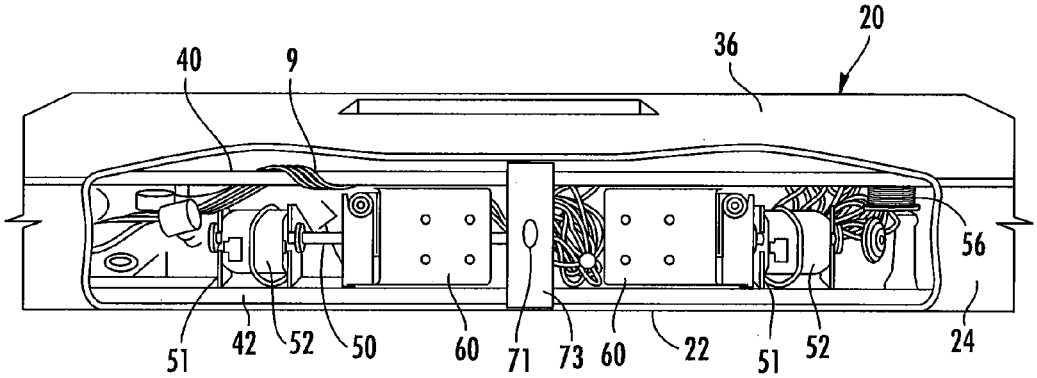
FIG. 2 is a cut-away perspective view showing the hardware located in the head rail in the package of FIG. 1.
Figure 3:
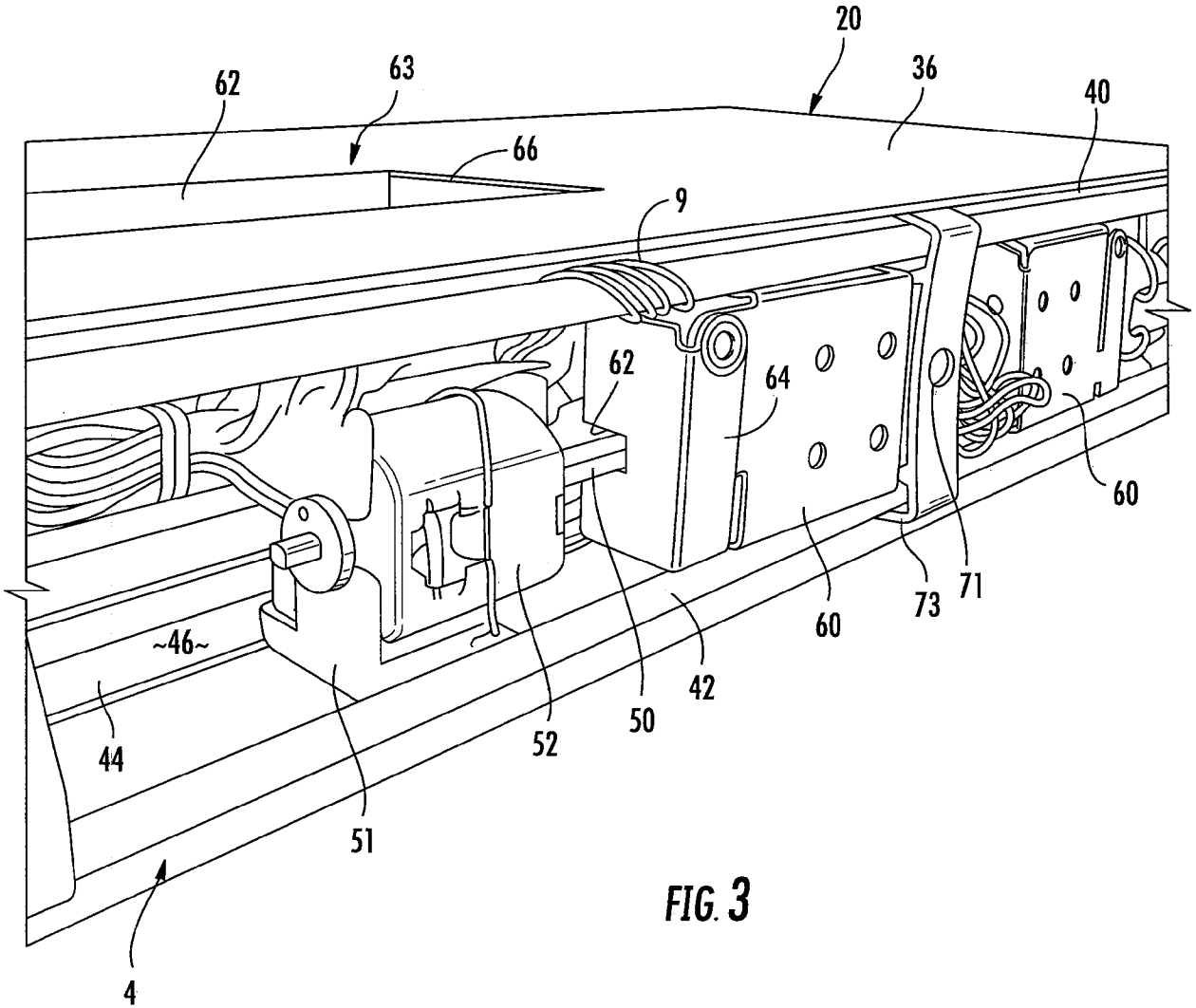
FIG. 3 is a detailed cut-away perspective view showing the hard ware in the head rail.

Referring to FIGS. 1 to 3 an example blind construction is shown generally at 1. Blind 1 is a slatted blind and comprises blind elements including a plurality of slats 2 connected together by lift cords 8 and having a head rail 4 and a bottom rail 6. It will be appreciated that in some blind styles the bottom rail may be omitted. The cords 8 are woven between the slats 2 to support the slats and tilt the slats to open and close the blinds. Lift cords 9 (FIG. 3) may be provided to raise and lower the blinds as well as brakes, motors, cord locks or other devices as are known in the art. While one type of blind is illustrated, it is to be understood that the method and apparatus can be used with any cut-to-size blind.

FIGS. 1 through 3 show an embodiment of the package used to facilitate the cutting operation. A package comprising box 20 is provided consisting of a support defined by a flat bottom wall 22 and opposed side walls 24 and 26 and opposed end walls 28 and 30. Package 20 is shown as a cardboard box but may be made of pressboard, plastic or other material that can be cut using blind cutting machines.

The side walls 24 and 26 and end walls 28 and 30 extend substantially perpendicularly from bottom wall 22 to create an interior space for receiving the blind 1. The distance between the end walls 28 and 30 is slightly longer that the width of the blind such that when blind 1 is placed in the container package 20 the blind elements will be snuggly trapped between end walls 28 and 30 to fix the blind elements in the aligned position relative to one another. Moreover, the sidewalls 24 and 26 and the end walls 28 and 30 and the bottom wall 22 are dimensioned such that the blind, when loaded in container 20, will be received in the interior space such that the blind elements will not be able to shift positions in the box. A cover 36 may be provided to secure the blind 1 within the box. The cover 36 may be connected to the support at a hinge 38 that is attached to one of the side walls or end walls. The hinge 38 may be a living hinge where the cover and side walls and end walls are made of a single piece of material or the hinge 38 may be a separate physical hinge.

A retaining member 63 extends from the cover 36 or support 22 toward the interior of package 20 for retaining the blind 1 in the package. It is to be understood that because the package 20 and blind 1 are both cut during the cut-to-size operation, the end walls 28 and 30 of the package will be cut off such that without the retaining member 63 it is possible for the blind 1 to slide out of the package 20 after the cutting operation is completed if the package is oriented with one of the ends of the package facing down. The retaining member 63 retains the blind in the package even after the ends of the package are removed.

In the illustrated embodiment the retaining member 63 comprises a flap 62 that is cut out of the cover 36 such that it can be folded along line 64 to extend into the interior of the package. A window 66 is created when flap 62 is folded. The flap 62 is located such that it extends between the head rail 4 and the slat adjacent the head rail. The flap 62 is dimensioned such that it is located between cords 8 and extends for substantially the depth of the package. The flap 62 will retain the blind in the package even after the ends of the package are cut off during the sizing operation due to the friction between the head rail and top slat and the flap 62 and the physical engagement between the flap 62 and cords 8.

Figure 4:
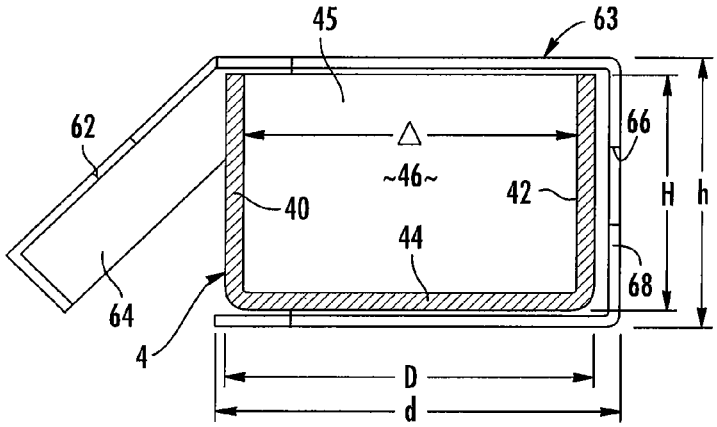
FIG. 4 is a partial section side view showing the head rail in a mounting bracket.

The head rail 4 comprises a generally hollow member that may comprise a U-shaped structure having a front wall 40 and rear wall 42 connected by a bottom wall 44 defining an interior space 46. The ends of the head rail may be closed by side walls 45 (FIG. 4). Located within the interior space 46 are the mechanisms and components for operating the blinds. These mechanisms and components may comprise a drive rod 50 that extends along the head rail 4 for a portion of the length thereof and is rotatably supported by mounting flanges 51 in the head rail such that it can rotate along its length. The drive rod 50 may support spools 52 that in turn support the tilt cords 8. The drive rod 50 may be rotated by a tilt wand or other mechanism (not shown) to rotate the drive rod to thereby rotate the spools 52. As the spools 52 rotate the tilt cords 8 are reciprocated to tilt the slats and open and close the blinds as is known in the art. The head rail 4 may also support guides, spools or other structures 56 for supporting and guiding the lift cords through the head rail such that when the exposed ends of the lift cords 9 are pulled or released by a user, the blinds can be raised and lowered as is known in the art. The head rail may also support a cord lock for locking the lift cords in the desired position or a motor for moving the blind.

The mechanisms and components described above form part of the head rail structure and are typically fixed in the head rail 4 during the manufacturing process of the blind. These components are located in the head rail 4 between lines A-A (FIG. 1) such that the blinds can be cut without interfering with the operation of the blind by cutting the blinds between the ends of the blind and lines A-A (FIG. 1). Thus, lines A-A define the maximum depth M a cut can be made from the end of the blind. The area of the blind between the lines A-A is a first portion of the blind that is not intended to be cut and the portions of the blind M between each of the lines A-A and the ends of the blind are second portions of the blind that are intended to be cut.

A typical blind is also sold with loose hardware. For example, a blind may be sold with a separate tilt wand that can be attached to the tilt mechanism in the head rail, mounting brackets for mounting the window covering to a surface such as a wall or window frame, screws for securing the mounting brackets, cord tie downs or the like. Because the blind is mounted in the package 20 where the package 20 is cut with the blind 1, if the hardware is mounted in the package to the outside of the lines A-A, e.g. at the ends of the blind, the hardware may be lost when the ends of the blind and package are cut off the central portion of the blind. Even if not lost, the hardware would become separated from the blind such that the consumer would have to keep track of two packages, one with the blind and the other with the hardware. Further, it is important that the hardware is packaged in a manner that it will not inadvertently interfere with the cut. It is desirable to package the hardware between the lines A-A to ensure that the hardware is not in the path of the cut. Moreover, it is desirable to package the hardware in the head rail 4 in order to minimize the size of the package and ensure that the blind is closely held by the package.

The hardware is stored in the head rail 4 between the lines A-A. In this manner the hardware will not interfere with the cut yet the package 20 will have the smallest profile for the packaged blind. Smaller hardware pieces such as the screws may be inserted into the head rail between the blind components. Further, the lift cords 9 that extend from the head rail are also inserted into the head rail between the lines A-A as shown in FIGS. 2 and 3. The tilt wand may also be located in the head rail 4 between lines A-A.

Larger pieces of hardware, such as the mounting brackets 60, are specifically designed to fit into the head rail 4 as will be described. It will be appreciated that the head rail 4 has a height H and a depth D. The mounting bracket 60 has a height h and a depth d where generally h>H and d>D such that the ends of the head rail 4 may be inserted into the mounting brackets 60 to mount the window covering on a surface. The mounting bracket 60 is designed such that the height dimension h of the mounting bracket is less than the depth Δ of the interior space 46. In this manner the bracket 60 may be oriented to fit into the interior space 46 of the head rail 4. Because each of the mounting brackets 60 is located in the head rail 4 between the lines A-A, the mounting brackets are located in the area of the head rail where the internal components of the window blind are also located. In this area the interior space 46 may not include an open area large enough to accommodate the mounting brackets. Accordingly, the mounting brackets 60 are formed to nest or interdigitate with one or more of the internal components of the window blind such that the mounting brackets can be fit into the interior space 46 of the head rail 4. In the illustrated embodiment, each mounting bracket 60 includes a first notch 62 formed in the pivoting door 64 and a second notch 66 formed in the opposite end wall 68 where the notches 62 and 66 are aligned and are dimensioned to receive the drive rod 50 such that the bracket can fit into the interior space 46 of head rail 4 and be inside of or substantially flush with the top edge of the head rail. While the notches are shown in the door 64 and end wall 68, the door 64 may be replaced with another end wall or eliminated altogether. While the brackets 60 are shown with notches 62 and 66 formed to accept drive shaft 50, the brackets may be formed to nest or interdigitate with other components. For example, the brackets may be formed to fit around spools 52 and have notches or other structure to accept the mounting flanges 51. The walls of the mounting brackets 60 are configured to nest with the internal components of the blind such that the brackets and components nest or overlap as is shown in the drawings.

One of side walls 24 or 26 have an aperture 70 formed therein for aligning the blind in the cutting machine as will hereinafter be described. In the illustrated embodiment the blind is in the retracted position with the slats, head rail and bottom rail parallel to one another and abutting or in close proximity to one another. This is generally the position of the blinds when the blinds are in the completely raised position when mounted on a window. After the blind 1 is loaded into the container 20, the blind is aligned such that the ends of the blind elements such as the slats, head rail and bottom rail are in a common plane.

The cutting machine may include a finger that extends into engagement with a hole 71 formed on the head rail 4. Aperture 70 is provided in the package 20 to allow access to the head rail 4 of the blind when the blind is located in the package. IN the illustrated embodiment hole 71 may be formed in a bracket 73 that is attached to the head rail 4. The flap 40 may also include an aligned aperture 72. Other centering mechanisms may also be used to locate the center of the blind.

Figure 5:
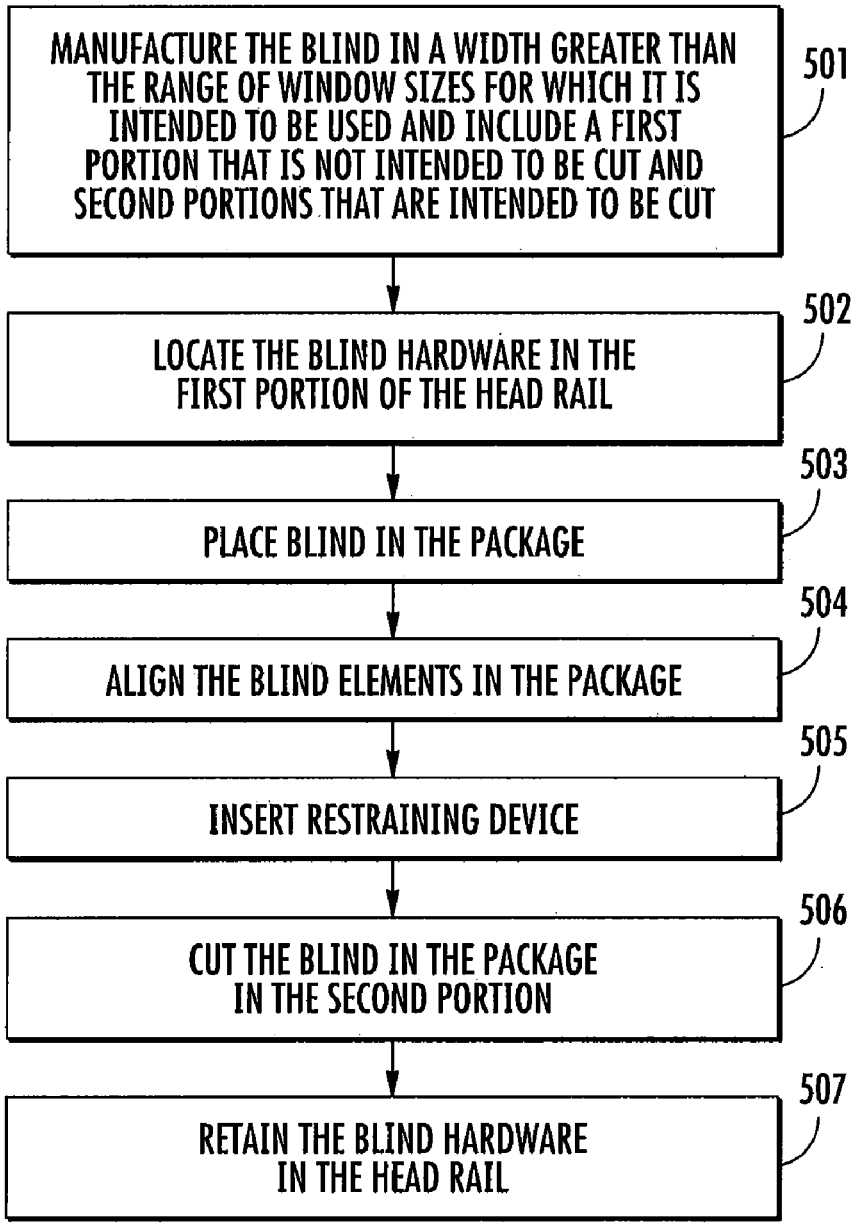
FIG. 5 is a block diagram illustrating a method of operation of the invention.

Operation of the method of the invention will now be described with reference to the flow chart of FIG. 5. The blind is manufactured in a width greater than the range of window sizes for which it is intended to be used and includes a first portion that is not intended to be cut and second portions that are intended to be cut, block 501. The blind hardware is located in the head rail 4 in the first portion of the blind, block 502. The blind is placed in package 20, block 503. The blind elements such as the slats, head rail and bottom rail are aligned so that the ends of these elements are in a common plane, block 504. The retaining device may be inserted between the blind elements to retain the blind in the package, block 505. The blind elements are cut while the blind is in the package in a second portion of the blind, block 506. The blind hardware is retained in the package in the head rail, block 507.

Specific embodiments of an invention are disclosed herein. One of ordinary skill in the art will recognize that the invention has other applications in other environments. Many embodiments are possible. The following claims are in no way intended to limit the scope of the invention to the specific embodiments described above.

The invention claimed is:

1. A package and a blind comprising;

a package for retaining a blind;

a blind having a head rail defining an interior space, said head rail having a first portion that is intended to be cut and a second portion that is not intended to be cut, a component of said blind being located in said second portion, said component forming part of the head rail structure and being used to operate the blind;

a mounting bracket associated with said blind located in the interior space in said second portion when said blind is retained in the package, said mounting bracket overlapping with said component in the head rail.

2. The package of claim 1 wherein said mounting bracket includes a notch for receiving a first blind component.

3. The package of claim 2 wherein said first blind component is a rod.

4. The package of claim 1 wherein said mounting bracket is located entirely within said head rail.

5. The package of claim 1 wherein said head rail has a height H and a depth D and said mounting bracket has a height h and a depth d where h>H and d>D such that the ends of the head rail may be inserted into the mounting bracket.

6. The package of claim 5 wherein said height h of the mounting bracket is less than a depth of the interior space.

7. A package and a blind comprising;

a package for retaining a blind;

a blind having a head rail defining an interior space, said head rail having a first portion that is intended to be cut and a second portion that is not intended to be cut, a drive rod being located in said second portion, said drive rod forming part of the head rail structure and being used to operate the blind;

a mounting bracket located in the interior space in said second portion when said blind is retained in the package, said mounting bracket comprising a notch for receiving the drive rod when the mounting bracket is located in the head rail.

8. The package of claim 7 wherein said head rail has an external height H and an external depth D and said mounting bracket has a height h and a depth d where h>H and d>D such that the ends of the head rail may be inserted into the mounting bracket and said height h of the mounting bracket is less than a depth of the interior space.

9. A package and a blind comprising;

a package for retaining a blind;

a blind having a head rail defining an interior space and having an open end defined by a top edge, said head rail having a first portion that is intended to be cut and a second portion that is not intended to be cut, a component of said blind being located in an interior space of said second portion, said component forming part of the head rail structure and being used to operate the blind, said interior space having a dimension;

a mounting bracket associated with said blind having a second dimension that is less than said dimension, said mounting bracket being located in the interior space in said second portion when said blind is retained in the package such that said mounting bracket nests with said component and is below or flush with said top edge when the mounting bracket is located in the head rail.

10. The package of claim 9 wherein said head rail has an external height H and an external depth D and said mounting bracket has a height h and a depth d where h>H and d>D such that the ends of the head rail may be inserted into the mounting bracket and said height h of the mounting bracket is less than a depth of the interior space.

11. The package of claim 9 wherein said mounting bracket comprises a notch for receiving the component.

12. The package of claim 11 wherein the component comprises a drive rod.

* * * * *